United States Patent [19]

Habib, Jr.

[11] 4,258,955

[45] Mar. 31, 1981

[54] PROCESS FOR IN-SITU LEACHING OF URANIUM

[75] Inventor: Edward T. Habib, Jr., Richardson, Tex.

[73] Assignee: Mobil Oil Corporation, New York, N.Y.

[21] Appl. No.: 973,327

[22] Filed: Dec. 26, 1978

[51] Int. Cl.[3] ..... E21B 43/28

[52] U.S. Cl. ..... 299/5

[58] Field of Search ..... 299/4, 5, 6

[56] References Cited

U.S. PATENT DOCUMENTS

| | | | |
|---|---|---|---|
| 2,818,240 | 12/1957 | Livingston | 299/4 |
| 2,954,218 | 9/1960 | Dew et al. | 299/6 X |

*Primary Examiner*—William F. Pate, III

*Attorney, Agent, or Firm*—Charles A. Huggett; James F. Powers, Jr.

[57] ABSTRACT

Process for the in-situ leaching of uranium from a subterranean ore deposit employing a lixiviant containing a carbonate leaching agent and an oxidizing agent. The lixiviant is heated to a temperature of at least 110° F. prior to injection into the subterranean ore deposit. The use of a heated lixiviant provides for a substantially greater ultimate uranium recovery than that attained through the use of a lixiviant injected at ambient temperature conditions. The process may be carried out in several stages. In the first stage, a relatively low temperature lixiviant is injected. This is followed by a second stage in which the lixiviant is heated to an elevated temperature and then injected into the deposit. The invention is particularly applicable for use in subterranean deposits which contain uranium associated with carbonaceous material.

5 Claims, No Drawings

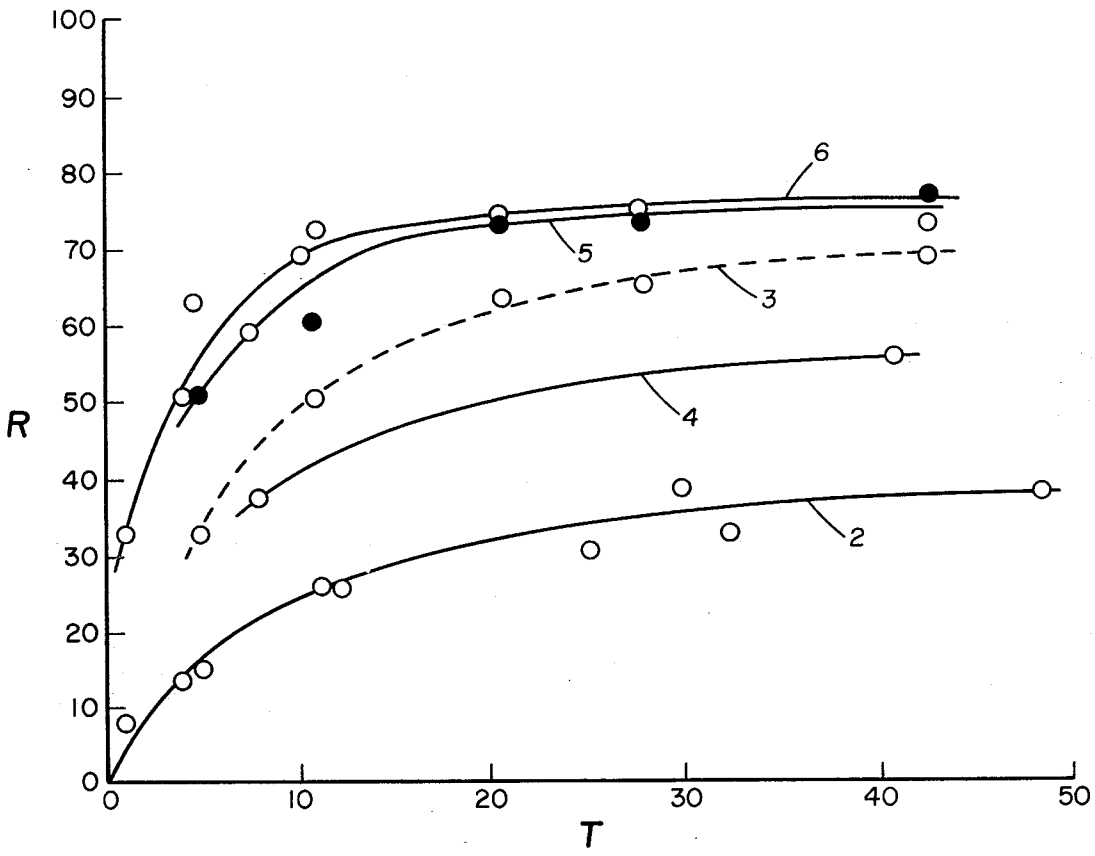
R
100
90
80
70
60
50
40
30
20
10
0
T
0
10
20
30
40
50
2
3
4
5
6

PROCESS FOR IN-SITU LEACHING OF URANIUM

BACKGROUND OF THE INVENTION

The present invention relates to the recovery of uranium from subterranean ore deposits and more particularly to in-situ leaching employing a heated carbonate lixiviant.

The various techniques for the production of uranium ore deposits may be characterized as falling within two general classes. One involves a surface milling operation in which uranium ore obtained by mining is crushed and blended and then subjected to a leaching procedure in which lixiviant containing a suitable leaching agent is employed to extract uranium from the milled ore. The uranium is then recovered from the pregnant lixiviant by a suitable technique such as solvent extraction, direct precipitation, or by absorption and elution employing an ion exchange resin. The other involves in-situ leaching in which a lixiviant is introduced into a subterranean ore deposit through a suitable injection system. The lixiviant solubilizes uranium values as it traverses the ore body. The pregnant lixiviant is then withdrawn from the ore body through a production system and treated to recover uranium therefrom by suitable techniques such as noted above. The lixiviants employed in either the aboveground mill leaching or the underground in-situ leaching may generally be classified as containing a carbonate or an acidic leaching agent. In acid leaching, the most commonly employed acid is sulfuric acid added in an amount to provide a pH in the lixiviant of about 2 or less. Carbonate lixiviants contain carbonate or bicarbonate ions or mixtures thereof which function to complex the uranium in the form of the water-soluble uranyl tricarbonate ion. The carbonate lixiviants may be formulated by the addition of alkali metal carbonates and/or bicarbonates or by the addition of carbon dioxide and an alkaline agent, e.g. sodium hydroxide, to control the pH. In most in-situ leaching operations, the lixiviant contains a carbonate leaching agent since the presence of carbonate materials in the subterranean ore deposits will lead to consumption of an acidic leaching agent and also raise the possibility of plugging of the formation due to precipitation of reaction produces such as calcium sulfate.

In uranium mills, it is a conventional practice to carry out the leaching operation at elevated temperatures. Thus, Merritt, Robert C., THE EXTRACTIVE METALLURGY OF URANIUM, Colorado School of Mines Research Institute, 1971, in pages 83–97, discloses the general concepts involved in milling operations employing a carbonate leaching agent and recognizes that the reaction rate varies with temperature. For example, Merritt, on page 87, states that each 10° C. increase in temperature nearly doubles the reaction rate at constant pressure and, on page 94, states that typical operating temperatures for circuits using Pachuca tanks range from 75° to 80° C. Beverly et al., "Pilot Plant Alkaline Leaching of Uranium Ores", Proceedings of the Second United Nations International Conference on the Peaceful Uses of Atomic Energy, Vol. 3, United Nations, Geneva (1958), pp. 326–332, describe experimental work showing a similar relationship between temperature and reaction kinetics and note that although the rate of uranium dissolution varies markedly with temperature the amount of uranium ultimately extracted remains essentially the same.

Contrary to the practice followed in mill leaching operations, in-situ leaching operations have heretofore involved the injection of the lixiviant under ambient temperature conditions. Thus, U.S. Pat. No. 2,896,930 to Menke discloses an in-situ leaching process employing a carbonate leaching agent in a "cold" lixiviant, i.e. one injected at substantially atmospheric temperature or at the temperature of the underground deposit. Notwithstanding the teachings of Menke that "hot" leaching solutions are unnecessary, it has been proposed to precede the injection of lixiviant into a subterranean ore deposit by an in-situ combustion process. Thus, U.S. Pat. No. 2,954,218 to Dew et al. discloses carrying out an in-situ combustion process in a refractory ore deposit in which the uranium is associated with carbonaceous material which retards the leaching action of the lixiviant. In-situ combustion of the carbonaceous material is effected by the injection of air in order to heat the ore body to a temperature of about 600° F. or more. By thus burning the carbonaceous material, the uranium is exposed to the action of the subsequently injected lixiviant thus facilitating the leaching procedure.

SUMMARY OF THE INVENTION

In accordance with the present invention, there is provided a new and improved process for the production of uranium from a subterranean deposit by employing a heated lixiviant containing a carbonate leaching agent and an oxidizing agent. In carrying out the invention, the lixiviant is heated to a temperature of at least 110° F. prior to injection into the subterranean uranium deposit. The lixiviant is then introduced into the deposit through a suitable injection system and displaced through the deposit to solubilize uranium therein. The resulting pregnant lixiviant is then produced from the deposit through a production system and treated to recover uranium therefrom.

In a further embodiment of the invention, a carbonate lixiviant is injected into the subterranean deposit in several stages. In an initial stage, a relatively cool lixiviant, e.g. at ambient temperature conditions, is introduced into the deposit via the injection system. After the injection of the low temperature lixiviant for a desired period of time, the lixiviant is then heated prior to injection so that a relatively high temperature lixiviant is introduced into the deposit. The heating of the lixiviant can be accomplished through one or more increments until it reaches the desired temperature. A preferred application of the present invention is in refractory deposits which contain uranium associated with carbonaceous material.

BRIEF DESCRIPTION OF THE DRAWING

The drawing is a graph illustrating the relationship between uranium recovery and time for leaching tests carried out under different temperature conditions.

DESCRIPTION OF SPECIFIC EMBODIMENTS

This invention relates to an in-situ leaching process employing a carbonate lixiviant which is heated to an elevated temperature prior to injection into the subterranean ore deposit. The carbonate leaching agent may take the form of carbonate and/or bicarbonate or mixtures thereof in any suitable concentration, typically within the range of 0.1 to 0.5 weight percent. The lixiviant also contains a suitable oxidizing agent such as air, oxygen, hydrogen perioxide, or sodium chlorate. As will be understood by those skilled in the art, the oxidizing agent functions to oxidize the uranium from the insoluble tetravalent state to the soluble hexavalent state. The lixiviant may also contain sulfate ions such as provided by the addition of sodium sulfate or another alkali metal sulfate.

The use of a carbonate lixiviant heated to a moderately elevated temperature in accordance with the present invention not only increases the leaching reaction rate but, contrary to the prior art teachings noted above, also provides for a significant increase in uranium recovery. This is accomplished by a relatively modest input of heat energy far below that required in the in-situ combustion process of the type disclosed, for example, in the aforementioned patent to Dew et al. As a practical matter, the temperature of the lixiviant should be below its boiling point and in most cases it will be preferred to inject the lixiviant at a temperature within the range of 130° F.–190° F. The lixiviant temperatures referred to herein are at the face of subterranean uranium formation. Depending upon the injection rate and depth of the formation, some decrease in temperature may occur from the surface of the injection well to the formation. Usually, however, the heat loss will result in a temperature reduction of only a few degrees. For example, at a formation depth of 2100 feet and an injection rate of 80 gallons per minute, lixiviant at a surface temperature of 150° F. will decrease about 5° F. and enter the formation at about 145° F.

The results achieved through the use of a heated carbonate lixiviant, in accordance with the present invention, are illustrated by comparative laboratory experiments carried out at temperatures ranging from room temperature (about 75° F.) upwards to about 190° F. In one set of experiments, a "batch" procedure was followed in which 100 cubic centimeters of lixiviant containing a carbonate leaching agent was added to 20 grams of uranium ore in a reaction vessel equipped with a stirring mechanism or, alternatively, a reaction vessel which was placed in a shaker where it was subject to agitation. In each test, the lixiviant contained 4 grams per liter of sodium bicarbonate and was at a pH of about 8.2. The lixiviant was saturated with elemental oxygen at 800 psig, corresponding to an oxygen concentration of about 2.0 grams per liter at room temperature downwardly to a concentration of about 1.7 grams per liter at the higher temperature tests conducted at about 190° F. The uranium ore employed in this experimental work was a composite ore obtained from a number of wells penetrating the same ore zone. This uranium ore is a refractory ore in which the uranium is associated with carbonaceous material. The ore contains uranium in the form of coffinite occurring as individual grains and aggregates of grain in a matrix of carbonaceous material. The matrix contains other minerals such as pyrite, apatite, anatase or rutile and chlorite. The carbonaceous material occurs in a poorly sorted sandstone consisting of detrital quartz, feldspar and rock fragments. Locally abundant kaolinite or chlorite, calcite and the carbonaceous material are the primary cementing agents.

In the batch experiments, the mixture of lixiviant and ore was agitated by shaking or stirring over prolonged intervals with samples withdrawn periodically for analysis of uranium content. During the sampling procedure, both lixiviant and ore were withdrawn so that the ratio of lixiviant to ore in the reactors remained constant.

Two "low temperature" experiments were carried out following the above-identified procedure. In the first, the leaching test was carried out over a period of 43 days at room temperature, estimated to be about 75° F. The second test was run initially at 86° F. in a stirred reactor for about 4 days and was thereafter transferred to shaker reactor and continued at 75° F. (room temperature). The results of these experimental procedures are set forth in Tables I and II, respectively. In these tables, the first column identifies the sample number and the second column gives the elapsed time at which the sampling were performed. The third column gives the cumulative uranium concentration in the lixiviant expressed as parts per million of $U_3O_8$. The fourth column sets forth the cumulative uranium recovered expressed as percent of the original uranium concentration in the ore. In Table II, the last column sets forth the temperature in degrees Fahrenheit at which the test was performed during the interval preceding the sampling procedure.

Additional experiments following the above-described procedure were carried out at higher temperatures. The results for tests run at approximately 95° F., 112° F., and 145° F. are set forth in Tables III, IV, and V, respectively, in the same format as described above with respect to Tables I and II. As shown by the last column in Tables III and V, the temperatures during the run varied somewhat from the nominal values. In the test set forth in Table IV, the temperature was maintained constant throughout at 112° F. In analyzing the data set forth in Tables I through V, the reported recoveries for the 95° F. test (Table III) are considered to be in error on the high side due to an error in the assay or weight of the original sample or in the analysis of the pregnant lixiviant. Similarly, sample 4 of Table I and sample 2 of Table IV are considered to be erroneously high.

TABLE I

| Sample | Time (Days) | $U_3O_8$ Conc. | % Rec. |
|---|---|---|---|
| 1 | 5.0 | 15.2 | 15.4 |
| 2 | 12.0 | 25.8 | 26.3 |
| 3 | 29.75 | 38.7 | 39.5 |
| 4 | 42.75 | 51.8 | 52.9 |

TABLE II

| Sample | Time (Days) | $U_3O_8$ Conc. | % Rec. | Temp., °F. |
|---|---|---|---|---|
| 1 | 1.0 | 7.31 | 7.45 | 86 |
| 2 | 4.0 | 13.32 | 13.59 | 86 |
| 3 | 11.1 | 25.94 | 26.46 | 75 |
| 4 | 25.1 | 30.07 | 30.68 | 75 |
| 5 | 32.2 | 32.31 | 32.96 | 75 |
| 6 | 48.2 | 37.85 | 38.62 | 75 |

TABLE III

| Sample | Time (Days) | $U_3O_8$ Conc. | % Rec. | Temp., °F. |
|---|---|---|---|---|
| 1 | 4.8 | 32.2 | 32.9 | 93 |
| 2 | 10.8 | 49.6 | 50.6 | 99 |
| 3 | 20.6 | 62.0 | 63.3 | 97 |
| 4 | 27.8 | 63.9 | 65.2 | 94 |
| 5 | 42.5 | 66.7 | 68.1 | — |

TABLE IV

| Sample | Time (Days) | $U_3O_8$ Conc. | % Rec. |
|---|---|---|---|
| 1 | 7.7 | 36.7 | 37.4 |
| 2 | 20.7 | 60.9 | 62.1 |

TABLE IV-continued

| Sample | Time (Days) | $U_3O_8$ Conc. | % Rec. |
|---|---|---|---|
| 3 | 40.6 | 55.2 | 56.3 |

TABLE V

| Sample | Time (Days) | $U_3O_8$ Conc. | % Rec. | Temp., °F. |
|---|---|---|---|---|
| 1 | 4.8 | 50.2 | 51.2 | 145 |
| 2 | 10.8 | 59.7 | 60.9 | 147 |
| 3 | 20.6 | 72.9 | 74.4 | 142 |
| 4 | 27.8 | 72.9 | 74.4 | 140 |
| 5 | 42.5 | 75.8 | 77.3 | — |

TABLE VI

| Sample | Time (Days) | $U_3O_8$ Conc. | % Rec. | Temp., °F. |
|---|---|---|---|---|
| 1 | 4.6 | 61.9 | 63.2 | 192 |
| 2 | 10.7 | 71.3 | 72.8 | 192 |
| 3 | 20.5 | 73.4 | 74.9 | 187 |
| 4 | 27.6 | 72.5 | 74.0 | 186 |
| 5 | 42.4 | 71.6 | 73.1 | — |

TABLE VII

| Sample | Time (Days) | $U_3O_8$ Conc. | % Rec. |
|---|---|---|---|
| 1 | 1.0 | 32.55 | 33.21 |
| 2 | 4.0 | 50.35 | 51.37 |
| 3 | 5.0 | 48.82 | 49.82 |
| 4 | 5.0 | 50.71 | 51.74 |
| 5 | 7.4 | 57.66 | 58.84 |
| 6 | 10.0 | 67.57 | 68.95 |
| 7 | — | 67.0 | 68.4 |

The results of additional batch tests carried out at temperatures of about 190° F. are set forth in Tables VI and VII. In the first of these tests, the temperature varied between 186°–192° F. as set forth in the last column of Table VI. In the other test set forth in Table VII, the temperature was maintained constant throughout at 190° F. In the course of the test reported in Table VII, a number of relatively short shutdowns occurred in order to make repairs in the stirring equipment associated with the reactor. During these shutdowns, the lixiviant-ore mixture was held at room temperature and pressure. While most of these shutdown periods were relatively short, one lasted for 6 days and this period was not counted as leaching time. Sample numbers 3 and 4, in Table VII, represent the beginning and end of this 6-day shutdown period.

Results of the previously described experimental work are shown in the drawing in which the percent uranium recovery, R, is plotted on the ordinate versus the leaching time, T, in days plotted on the abscissa. Curve 2 is a composite graph of the test results set forth in Tables I and II with the exclusion of sample 4 in Table I discussed previously. Curve 3 is a plot of the uranium recovery set forth in Table III and is indicated by broken line to indicate the doubtful nature of the test data. Curve 4 illustrates the recoveries attained for the test carried out at 112° F. with no weight given to sample number 2 of Table IV. Curve 5 illustrates the results of the test carried out at 145° F. (Table V) and curve 6 is a composite of the test results set forth in Tables VI and VII for the experimental work carried out at about 190° F.

In reviewing the data presented in the drawing, it can be seen that an increase in temperature produced not only a higher leaching rate but also greater ultimate uranium recovery. A significant increase in recovery occurs for the test run at 112° F. (discounting the data obtained at 95° F.) and at 145° F. a substantially greater ultimate uranium recovery was obtained. The ultimate recovery associated with curve 6 is approximately the same as that associated with curve 5 indicating there is little incentive to heat the lixiviant to a temperature significantly greater than 145° F. for this ore.

The higher leaching rates observed at the higher temperatures can be attributed to chemical or diffusional kinetics. An explanation of the indicated higher ultimate uranium recoveries is more difficult. However, the pregnant lixiviant samples from the higher temperature runs were deep brown in color and upon analysis were found to contain dissolved organic material. Samples of pregnant lixiviant obtained during the low temperature runs were only slightly tinted. Thus, it appears possible that operating at higher temperatures causes oxidation and/or disaggregation of carbonaceous material associated with the uranium mineral, thus providing greater access to the uranium by the leaching agent.

In further experimental work, a pack leaching procedure was employed in which the uranium ore was packed into a column and the lixiviant then injected into one end of the column. The pregnant lixiviant was recovered from the other end of the pack and analyzed at intervals for its uranium content. In a first suite of pack tests, the column was packed with 1 part of the previously described composite ore mixed with 3 parts of barren sand. The lixiviant employed was the same as that used in the previously described batch test and was saturated with 800 psig oxygen. One test was carried out at room temperature and the other at 140° F. In each pack run, the lixiviant was injected initially at a rate of 0.2 pore volume per day and later reduced to a value of 0.05 pore volume per day. In the test carried out at room temperature, the lixiviant, with oxidizing agent, was injected as a preflush in an amount of 1.13 pore volumes. In the test carried out at 140° F., a preflush of the lixiviant without oxidizing agent was injected in an amount of 3.24 pore volumes. The results of the pack tests carried out at room temperature and at 140° F. are set forth in Tables VIII and IX, respectively. In each of these tables, the first column set forth the cumulative pore volume amount of lixiviant injected subsequent to the addition of oxidizing agent to the lixiviant, the second column the concentration of the uranium in the pregnant lixiviant as parts per million $U_3O_8$, and the last column the cumulative uranium recovery expressed as the percent of the original uranium concentration in the ore.

TABLE VIII

| Pore Volume | $U_3O_8$ Conc. | % Rec. |
|---|---|---|
| 0 | 28.2 | 5.6 |
| .24 | 34.8 | 7.1 |
| .47 | 33.8 | 8.5 |
| .65 | 28.7 | 9.4 |
| 1.29 | 18.3 | 11.5 |
| 1.66 | 12.3 | 12.3 |
| 1.89 | 15.3 | 12.5 |
| 2.13 | 17.6 | 13.6 |
| 2.35 | 18.9 | 14.4 |
| 2.37 | 18.8 | 14.5 |
| *2.57 | 23.1 | 15.3 |
| 2.66 | 24.2 | 15.7 |
| 2.67 | 29.5 | 15.8 |
| 2.9 | 27.7 | 16.9 |
| 3.01 | 32.6 | 17.5 |
| 3.13 | 35.0 | 18.3 |
| 3.31 | 35.9 | 19.4 |
| 3.45 | 36.2 | 20.3 |

TABLE VIII-continued

| Pore Volume | $U_3O_8$ Conc. | % Rec. |
|---|---|---|
| 3.57 | 34.2 | 21.2 |
| 3.7 | 33.4 | 21.8 |
| 3.79 | 31.4 | 22.3 |

*Injection rate reduced by ¼.

TABLE IX

| Pore Volume | $U_3O_8$ Conc. | % Rec. |
|---|---|---|
| .51 | .4 | .4 |
| .90 | 11.1 | 1.2 |
| 1.51 | 190.3 | 24.3 |
| 1.73 | 127.9 | 29.9 |
| 2.11 | 75.8 | 35.8 |
| 2.32 | 56.4 | 38.1 |
| 2.90 | 42.1 | 43.0 |
| 3.25 | 32.2 | 45.3 |
| 3.63 | 28.5 | 47.5 |
| 3.83 | 27.0 | 48.5 |
| 4.25 | 23.1 | 50.5 |
| 4.45 | 24.4 | 51.6 |
| 4.86 | 20.6 | 53.2 |
| *5.15 | 19.5 | 54.3 |
| 5.25 | 20.5 | 54.7 |
| 5.35 | 23.4 | 55.1 |
| 5.60 | 29.1 | 56.5 |
| 5.70 | 32.9 | 57.1 |
| 5.80 | 36.0 | 57.8 |
| 5.99 | 39.7 | 59.3 |
| 6.29 | 40.6 | 61.7 |
| 6.49 | 37.9 | 63.2 |
| 6.63 | 35.5 | 64.2 |
| 6.83 | 32.4 | 65.5 |
| 7.08 | 29.4 | 67.0 |

*Injection rate reduced by ¼.

A second set of batch tests was also carried out at room temperature and at 140° F. In this case, the columns were packed with the previously described composite ore without the addition of barren sand. The lixiviant contained 0.4 grams per liter of sodium bicarbonate as described previously but the oxidizing agent employed was hydrogen peroxide in a concentration of 3.3 grams per liter. The lixiviant was injected initially at a rate of 0.2 pore volume per day and later reduced by a factor of 8 to 0.025 pore volume per day. A preflush of lixiviant without the addition of oxidizing agent was carried out similarly as in the previously described pack test. In each of these tests, the preflush was injected in an amount of 1.8 pore volumes after which the injection of hydrogen peroxide was started. The results of this set of pack tests at room temperature and at 140° F. are set forth in Tables X and XI, respectively, in the same format as employed with respect to Tables VIII and IX.

An examination of the data presented in Tables VIII through XI indicates similarly, as in the case of the batch tests described previously, that heating the lixiviant to a temperature of 140° F. significantly increases the ultimate uranium recovery. Also the leaching rate, as indicated by the concentration of uranium in the pregnant lixiviant, was significantly higher for the high temperature runs once uranium production started to occur. However, in both high temperature pack experiments, initial uranium production was delayed after starting the injection of oxidizing agent by 1 to 2 pore volumes. The low temperature pack runs on the other hand resulted in the production of uranium much earlier in the leaching procedure.

TABLE X

| Pore Volume | $U_3O_8$ Conc. | % Rec. |
|---|---|---|
| .37 | 0 | 0 |
| .91 | 0 | 0 |
| 1.11 | 11.6 | 0.1 |
| 1.24 | 76.5 | 0.7 |
| 1.42 | 235.1 | 2.8 |
| 1.61 | 270.0 | 5.5 |
| 2.16 | 168.0 | 10.6 |
| 2.51 | 115.0 | 12.7 |
| 2.86 | 93.8 | 14.5 |
| 3.38 | 71.7 | 16.5 |
| 3.70 | 60.5 | 17.6 |
| 3.89 | 53.8 | 18.1 |
| 4.12 | 48.8 | 18.7 |
| 4.62 | 42.3 | 19.9 |
| *4.64 | 37.6 | 19.9 |
| 4.72 | 44.8 | 20.1 |
| 4.81 | 69.9 | 20.4 |
| 4.91 | 94.6 | 21.0 |

*Injection rate reduced by ¼.

TABLE XI

| Pore Volume | $U_3O_8$ Conc. | % Rec. |
|---|---|---|
| .37 | 0 | 0 |
| .91 | 0 | 0 |
| 1.11 | 0 | 0 |
| 1.25 | 0 | 0 |
| 1.42 | 0.5 | 0 |
| 1.60 | 0.1 | 0 |
| 2.14 | 1.8 | 0.1 |
| 2.49 | 18.8 | 0.4 |
| 2.85 | 92.9 | 2.3 |
| 3.40 | 475.8 | 16.4 |
| 3.75 | 650.9 | 28.5 |
| 3.94 | 412.7 | 32.8 |
| 4.16 | 196.3 | 35.2 |
| 4.64 | 117.3 | 38.2 |
| *4.73 | 89.6 | 38.7 |
| 4.82 | 126.7 | 39.3 |
| 4.97 | 136.1 | 40.4 |
| 5.11 | 141.7 | 41.5 |

*injection rate reduced by ¼.

In a further embodiment of the present invention, this characteristic is employed to advantage by carrying out the leaching procedure in several stages. Thus initially the lixiviant is injected into the formation at a relatively low temperature. As a practical matter the lixiviant may be injected during this stage simply at ambient temperature conditions or it may be heated moderately, preferably to a value no greater than 100° F. At a later stage in the procedure, the lixiviant is then heated so that it is injected into the formation at an elevated temperature. The initiation of the heating step may be based upon any one or more of several parameters. For example, the effluent from the production system may be monitored with respect to uranium concentration and the injection of heated lixiviant initiated after the uranium concentration of the pregnant lixiviant reaches a maximum and starts to decline. Preferably, however, the concentration of oxidizing agent in the lixiviant recovered from the producing wells is monitored. When the oxidizing agent exceeds a specified value, the temperature of the injected lixiviant is then increased. This mode of operation offers a significant advantage over the initial injection of heated lixiviant in that it tends to avoid a reducing environment, and thus the precipitation of tetravalent uranium, adjacent the production wells during the early stages of the leaching procedure.

A preferred application of the invention is in those deposits containing uranium associated with carbonaceous material as described previously. The carbonaceous material is present in intimate contact with the uranium mineral and retards access to the uranium by the lixiviant. The oxidizing agent functions to not only oxidize the uranium to the hexavalent state, but also to disrupt the carbonaceous material so that the uranium is exposed to the solubilizing action of the lixiviant. In most cases, the carbonaceous material is present in the uranium deposit in an amount of at least 0.1 weight percent expressed as total organic carbon. The concentration may range up to about 2% total organic carbon.

The present invention may be carried out utilizing injection and production systems as defined by any suitable well arrangement. One well arrangement suitable for use in carrying out the invention is a five-spot pattern in which a central injection well is surrounded by four production wells. Other patterns such as seven-spot and nine-spot patterns also may be employed as well as the so-called "line flood" pattern in which injection and production wells are located in generally parallel rows. Typically the spacing between injection and production wells will be on the order of 50 to 200 feet. In some instances, particularly where the subterranean uranium deposit is of a limited areal extent, injection and production may be carried out through the same well. Thus, in relatively thick uranium deposits, dually completed injection-production wells of the type disclosed, for example, in U.S. Pat. No. 2,725,106 to Spearow may be employed. Alternatively, injection of fresh lixiviant and withdrawal of pregnant lixiviant through the same well may be accomplished by a "huff-and-puff" procedure employing a well system such as disclosed in U.S. Pat. No. 3,708,206 to Hard et al.

As noted previously, in a preferred embodiment of the invention the lixiviant is injected initially at a relatively low temperature. The injection of the low temperature lixiviant is continued preferably until at least one pore volume is injected. The pregnant lixiviant recovered from the production wells may be monitored for the presence of oxidizing agents, e.g. oxygen, and when the concentration reaches a specified level indicative of a neutral or oxidizing environment adjacent the production wells, injection of the heated lixiviant is then started. For example, injection of the relatively low temperature lixiviant may be continued until the concentration of the oxygen in the produced lixiviant reaches a level of at least 20 parts per million. Thereafter the lixiviant may be diverted at the surface to a heater where where it is raised to the desired temperature and then injected into the injection wells.

As noted previously, any suitable oxidant may be employed in carrying out the invention. Normally, elemental oxygen will be used. Typically, oxygen pressure of the lixiviant may range from about 50 up to 1000 psig. The oxygen pressure should be less than the formation pressure in order to avoid oxygen coming out of solution and developing a gas phase in the formation.

I claim:

1. In the recovery of uranium from a subterranean uranium-containing deposit penetrated by injection and production systems, the method comprising:

(a) introducing an aqueous lixiviant containing a carbonate leaching agent and an oxidizing agent into said deposit via said injection system at a relatively low temperature and displacing said lixiviant through said subterranean deposit to solubilize uranium therein, (b) thereafter heating an aqueous lixiviant containing a carbonate leaching agent and an oxidizing agent to an elevated temperature greater than the temperature of step (a) and introducing said heated lixiviant into said deposit via said injection system, (c) producing pregnant lixiviant containing uranium from said production system, and (d) treating said pregnant lixiviant to recover uranium therefrom.

2. The method of claim 1 further comprising introducing said low temperature lixiviant into said deposit in an amount of at least 1 pore volume of said deposit, monitoring the produced loxiviant for at least one parameter, and after an indicated change in said monitored parameter is observed heating said lixiviant in accordance with step (b).

3. The method of claim 2 wherein the monitored parameter is the concentration of oxidizing agent in said produced lixiviant and step (b) is initiated after said oxidizing agent concentration reaches a specified level.

4. The method of claim 1 wherein said lixiviant in step (a) is injected at a temperature less than 100° F. and said lixiviant in step (b) is injected at a temperature of at least 110° F.

5. The method of claim 1 wherein said subterranean deposit contains uranium associated with carbonaceous material.

* * * * *